US006719225B1

(12) United States Patent
Hesch

(10) Patent No.: US 6,719,225 B1
(45) Date of Patent: Apr. 13, 2004

(54) DEVICE AND METHOD FOR PRE-DISINTEGRATING AND CUTTING INTO SECTIONS FIBROUS PLANTS AND FOR THE SEPARATION OF FIBERS AND WOODY PARTS

(76) Inventor: Rolf Hesch, Steinkamp 2c, D-32657 Lemgo-Luerdissen (DE)

( * ) Notice: Subject to any disclaimer, the term of this patent is extended or adjusted under 35 U.S.C. 154(b) by 0 days.

(21) Appl. No.: 09/647,114

(22) PCT Filed: Mar. 18, 1999

(86) PCT No.: PCT/DE99/00779

§ 371 (c)(1),
(2), (4) Date: Dec. 18, 2000

(87) PCT Pub. No.: WO99/48609

PCT Pub. Date: Sep. 30, 1999

(30) Foreign Application Priority Data

Mar. 26, 1998 (DE) ..... 198 13 397

(51) Int. Cl.[7] ..... B02C 18/16; B02C 19/12

(52) U.S. Cl. ..... 241/28; 241/101.3; 241/242; 241/294

(58) Field of Search ..... 241/294, 242, 241/101.3, 28

(56) References Cited

U.S. PATENT DOCUMENTS

| | | | |
|---|---|---|---|
| 1,648,422 | A | 11/1927 | Oppenheim |
| 3,040,794 | A | 6/1962 | Jacobsen |

FOREIGN PATENT DOCUMENTS

| | | |
|---|---|---|
| DE | 3400252 | 7/1985 |
| EP | 0160953 | 11/1985 |
| EP | 0164489 | 12/1985 |
| FR | 2492218 | 4/1982 |
| GB | 324960 | 2/1930 |

*Primary Examiner*—Mark Rosenbaum
(74) *Attorney, Agent, or Firm*—Frost Brown Todd LLC

(57) ABSTRACT

A device and method are provided for pre-disintegrating and cutting fibrous plants to staple length for the separation of fibres and woody parts with the goals to accelerate drying, if applied during harvesting, but mainly to facilitate separation of woody parts before the main fiber recovery machine in order to increase useful performance of same. The device includes a cutting rotor, a supply devoce, cutting blades, and one or more impact or snapping tools. In some fields of application, for example, pulp and paper manufacture or manufacture of insulating material, the degree of pre-disintegration or pre-decortication attained with the device and process, is sufficient so that a further decortication can be dispensed thus improving efficiency.

11 Claims, 2 Drawing Sheets

DEVICE AND METHOD FOR PRE-DISINTEGRATING AND CUTTING INTO SECTIONS FIBROUS PLANTS AND FOR THE SEPARATION OF FIBERS AND WOODY PARTS

Device and method for pre-disintegrating and cutting into sections fibrous plants and for the separation of fibers and woody parts.

The goal of the invention is, to carry out a technical and cost-advantageous on-line pre-disintegration during the preliminary cutting into sections of fibrous plant stalks or stems, for the purpose of the recovery of fibers, before a-cutting into sections takes place, and subsequently, to separate the fractions thereby formed from one another.

Figure 1:
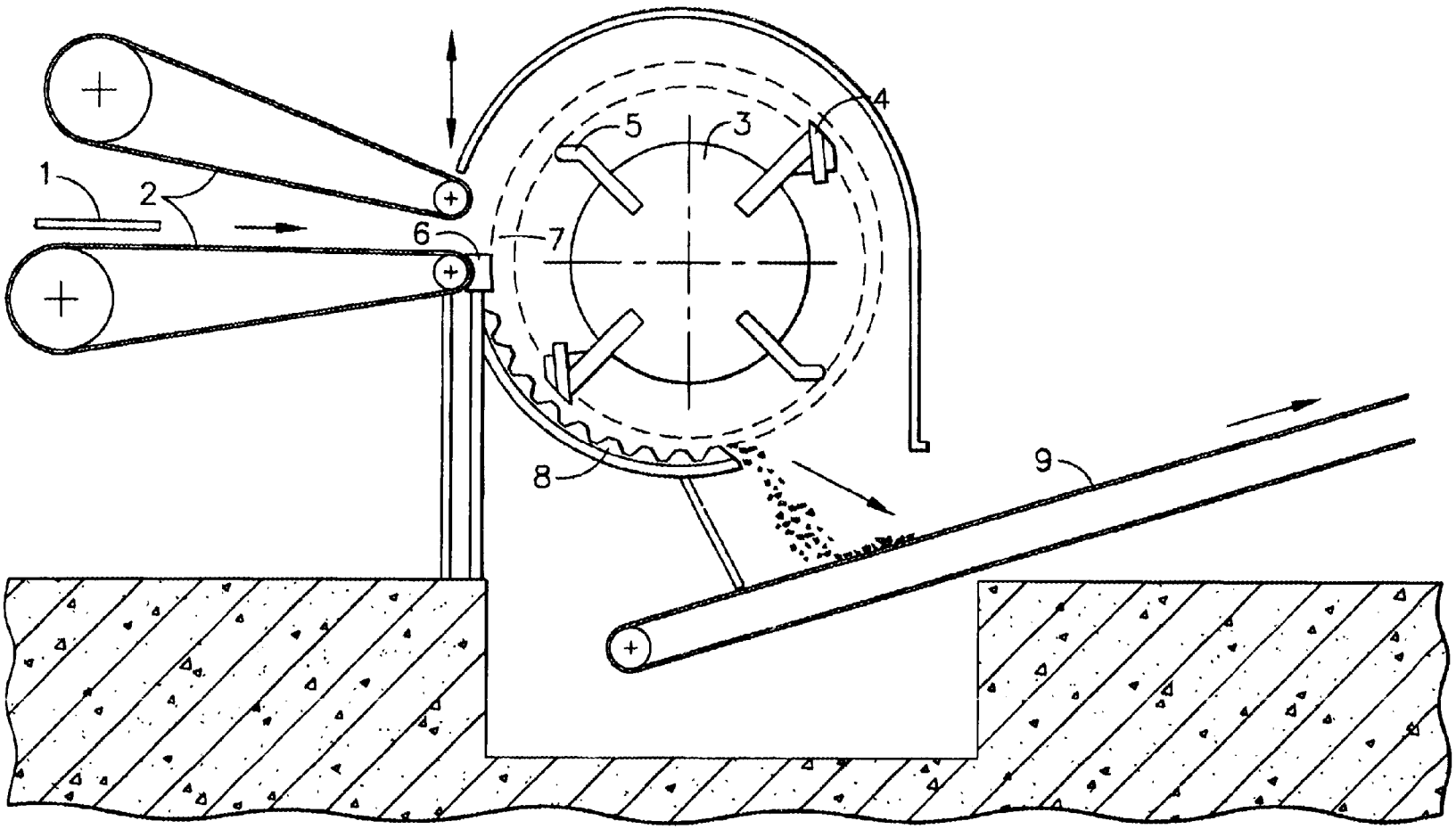
FIG. 1 is a partially diagrammatic view of the disintegrating and cutting device of the present invention.
Figure 2:
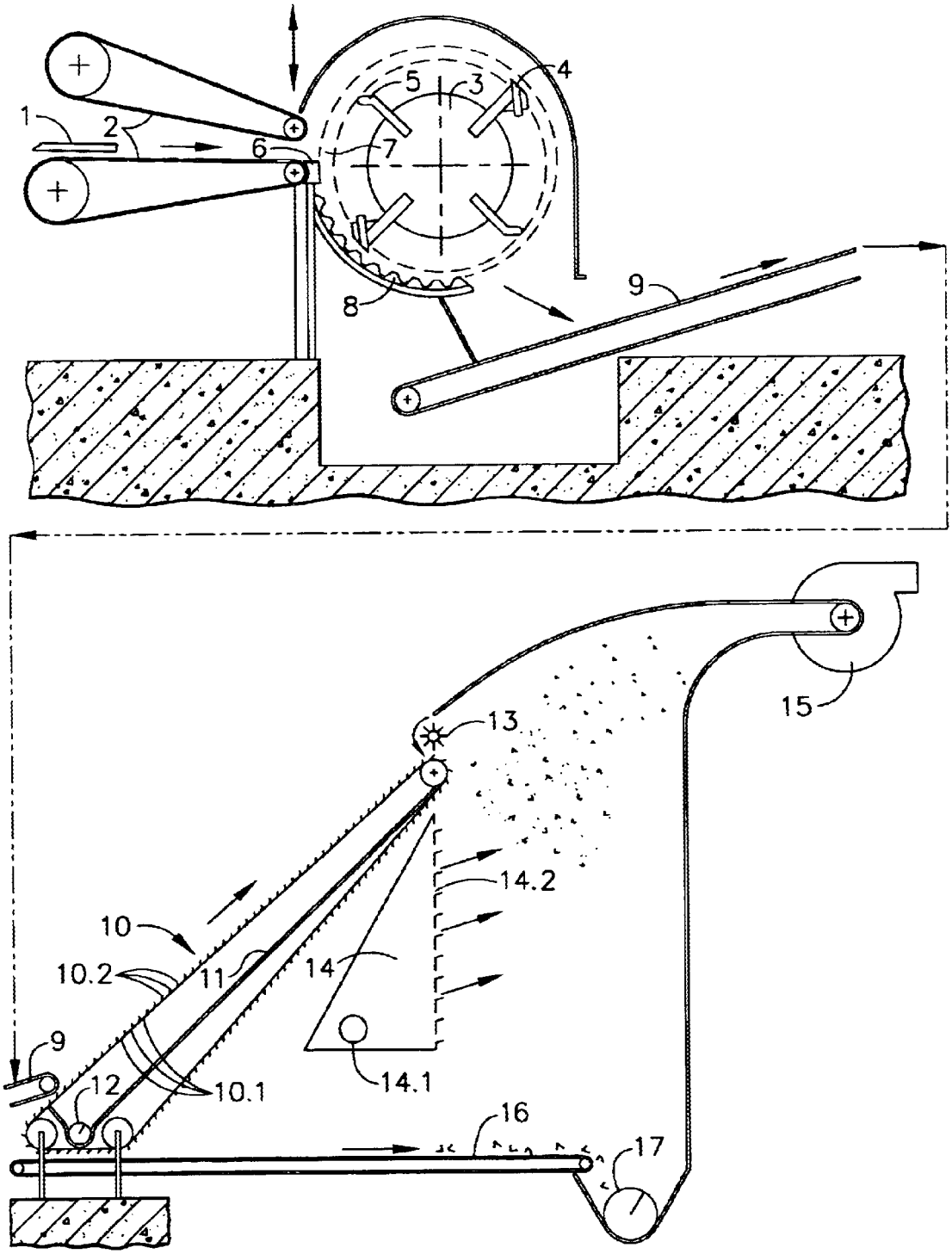
FIG. 2 is a partially diagrammatic view of the disintegrating and cutting device of the present invention in combination with a sifting system.

According to the state of the art, a pre-disintegration is not known. The stalk material of the fibrous plants is either harvested in full length or cut into lengths during the harvest, by simple cutting operations, in sections of 500 to 600 mm or with stepped mowing machines, to mostly 600 to 1200 mm, sometimes even more. According to another process, the stalk material is cut, by simple cut, to sections of mostly between 2 and 150 mm before the so-called decortication. Pre-disintegrations are not carried out thereby.

A pre-disintegration of the stalk material can bring considerable technical and economic advantages both during the harvest as well as during the recovery of fibers. During the harvest, a moderate pre-disintegration of the grown stalk structures means that numerous cracks in the stalk or the stalk section are formed. This considerably promotes the evaporation of the moisture contained in the stalk. The drying of the crop is thus greatly accelerated. Periods of good weather can be better utilized. The harvest risk is considerably reduced. The bonding between the fiber components and the woody parts is also loosened so that a percentage of the woody parts, which can be influenced within limits, can already be separated from the material flow before the very energy-intensive fiber recovery process, and relief can be provided to the main unit in this way.

The pre-disintegration in the course of the harvesting process must, however, be done moderately. It may not go so far that woody parts already fall off in the field. They would be lost for further utilization. As a secondary product, these parts have a not insignificant importance and should therefore be recovered also.

The mechanical action of the pre-disintegration during the course of the harvesting process also makes it possible for a large part of the leaves, which are unsuitable for further utilization, to be comminuted and fall away. In this way, a cleaner crop is obtained. The material unsuitable for further utilization remains as a natural fertilizer on the field.

It is only in the fiber recovery unit that, in a second stage, a pre-disintegration, which is identical in principle, takes place, but with a much higher intensity, so as to separate as much wood content as possible from the material flow at this point, before the actual fiber recovery machine and thus to relieve this very energy-intensive machine and to increase its useful performance. In this way, costs can be reduced considerably. The fiber recovery machine is complicated, expensive and has a large energy consumption. To reduce its load of nonfibrous material lowers investment and operating costs, especially the consumption of electrical energy. Thus, a contribution to better ecological practices is also made.

Another goal of the invention is to facilitate and carry out more completely the separation of woody parts or shives from the main product, the fibers. It has been shown, namely, that shives/woody parts already detached from the fibers increasingly get caught up with the fibers once more, the more finely the fibers and shives/woody parts are disintegrated, unraveled, and comminuted in the course of the other process steps. The goal of the invention is thus to sift out as large as possible a fraction of the shives/woody parts from the fibers, as long as they are still coarse and large and can be sifted out and separated from the fibers. In this way, the expense of the cleaning of the fibers as the last stage of the recovery of the fibers can be significantly reduced.

For some fields of application, the degree of pre-disintegration or pre-decortication, which is attained with the solution in accordance with the invention, is sufficient so that a further breakdown or unraveling can be dispensed with. Then, there is a particularly high cost savings.

According to the state of the art, only one process, which is also the invention of the applicant of this application, undertakes a final cutting to the desired staple length of the fibers before the recovery of fibers from bast plants. The loose material, cut to intermediate length during the harvest, is thus once again cut to length in a further cutting stage at the decortication plant. The loose material is then decorticated or separated into fibers in a mill by impact, friction or shearing for the purpose of recovering the fibers. According to the state of the art, the precomminuted material is fed, in its entirety, to the mill. This means that the mill is also burdened, in an unproductive manner, by leaves, woody parts, or other foliage components, and a correspondingly large amount of energy is senselessly consumed.

The invention concerns a process and a device for the pre-disintegration and cutting to length of fibrous plants and for the separation of fibers and woody parts.

The goal of the invention under consideration is attained in that machines, which are, in fact, known, both for harvesting and for the final cutting to length are modified and supplemented in such a way that they subject the stalk or stem material found at the entry of the cutting machine to an impact and/or snapping action. When cutting during harvest, it is limited in its intensity, so as to avoid losses of usable material on the field. During the pre-disintegration/pre-cutting to length at the decortication plant, on the other hand, the effect is utilized in its full intensity, so as to split and detach the brittle, wood-like material of the stalk, whereas the flexible fibers are partially or even greatly loosened from the rigid woody part by the shear stresses which arise. The dry leaves and other foliage parts still contained in the charging material are split with these operations and decompose predominantly to granules and dust. After this preliminary splitting, the cutting to length takes place then, by use of a blade which follows, which also represents an impact-like intervention into the material to be cut to length. This hard intervention leads to an enlargement of the cracks in the wood part and between the woody part and the fibers or fiber bundles, and a large part of the wood is detached from the fibers. Detached woody parts and fibers or fiber bundles with still attached wood can then be separated from one another, in a known manner, using screens, pneumatic sifters, pneumatic jigs, and other such devices. Only a reduced material quantity with a very increased fiber fraction goes into the actual decortication or fiber recovery machine—that is, a kind of fiber concentrate—since, in fact, a large part of the woody components and the fine material were already separated. The actual decortication machine, which is not the object of the invention under consideration, can thus bring about a very much higher performance on completely decorticated/fiber-stripped material or it can be built to a smaller scale. The specific energy consumption drops considerably, since now, only a fraction of woody substance must still be comminuted in the actual decortication or fiber recovery machine—that is, considerably less unproductive work, with respect to decortication/fiber recovery, is performed.

The brittle, woody material is vigorously recomminuted in the actual decortication/fiber recovery unit. The more woody the material that goes into the decortication machine, the more that vigorously comminuted shives/wood parts are then contained in the fibers. Since the fibers are very vigorously unraveled also by the decortication/fiber recovery—that is, are refined—a disadvantageously strong mechanical crosslinking/matting between the fibers and the comminuted wood parts arises, which results in an increased expense during the cleaning of the fibers from the woody parts. Technical expenditure and costs can be appreciably lowered if it is possible to introduce as low as possible a fraction of wood into the actual decortication unit, so that the fraction of recomminuted shives/wood in the fibers which leave the decortication unit is as low as possible.

FIG. 1 illustrates the device with the aid of the preferred embodiment. The stalk or stem material (1) is conducted to a cutting rotor (3) at a constant rate, via a supply device (2). The cutting rotor (3) is equipped with at least one blade (4) and at least one impact and snapping tool (5). The impact and snapping tool (5) has a shorter radius than the cutting blade (4) so that after the impact, it can slide by the snapped-off material without blocking the machine. In accordance with the invention, the impact and snapping tool can be placed in a yielding manner, so that it can move back in the case of a high material layer. Likewise, it should be possible to construct the impact tool in segments also, in order to permit an adaptation to different layer thicknesses. Several impact tools arranged in series [increase] the pre-disintegration/pre-decortication effect.

The working sequence is as follows: After each cut, the stem material (1) from the feeding system is supplied to the cutting chamber (7) via the counter-blade (6). At the moment when the impact or snapping tool (5) arrives at the height of the counter-blade (6), the stalk material (1) already protrudes over the counter-blade (6) into the cutting chamber. It also protrudes beyond the radius of action of the impact or snapping tool, in the direction of the center of rotation of the cutting rotor (3). The impact or snapping tool (5), rotating past the counter-blade (6), strikes the stalk or stem material protruding into its radius of action and snaps it over the edge of the counter-blade (6) in the direction of rotation, downwards. The rigid/brittle wood parts break thereby. At the same time, cracks are formed in the woody part, parallel to the longitudinal axis of the stalk/stem as a consequence of the shear stresses within the stalks/stems, brought about by the deformation. The shear stresses advantageously result in, for example, the bast in bast fiber plants being completely or partially peeled off or also only loosened from the wood.

FIG. 1 shows the phase of the snapping off of the stalk material (1) over the counter-blade (6). The impact or snapping tool (5) is followed by the cutting blade (4) because of the rotation direction of the cutting rotor (3). The radius of action of the cutting blade (4) is considerably larger than that of the impact and snapping tool (5). The cutting blade (4) then cuts the material snapped off by the preceding impact or -snapping tool (5), which material is therefore pre-disintegrated, in collaboration with the counter-blade (6). The cutting blade (4) then pushes the cut-off stalk sections forward over the rough fiction surface (8). Due to the resulting friction, wood splinters/shives, already partly detached from the fibers, are finally detached form the fibers and are thus made accessible to a fractionation.

The procedure is repeated alternatingly. Each snapping operation is followed by a cutting operation.

By means of the described treatment by impact and snapping, the fibers are loosened to a considerable extent from the splinters or shives of the wood core. The detached "shives" can then be separated and eliminated in a simple manner by screening or sifting.

So that the impact or snapping tools can slide past the snapped-off material after the impact, without blocking the machine, the preferred embodiment of the impact and snapping tools has a yielding arrangement, in order to be able to move back in case of a high material layer. Likewise, it should be possible to construct the impact tool (5) in segments also, in order to permit an adaptation to different layer thicknesses. Several impact tools arranged in series increase the pre-disintegration/pre-decortication effect. The material, which is thus increasingly broken down, then falls onto a conveyor (9), which discharges it from the machine to subsequent fractionating devices.

What is claimed is:

1. Device for pre-disintegrating and cutting into sections stalk- or stem-like, fibrous plant material for the purpose of decortication, comprising at least one impact or snapping-off tool (5) interposed upstream from at least one blade (4) of a cutting rotor (3) for the carrying out of preliminary cutting into sections of the plant material (1);

wherein said at least one tool is suitable for the loosening of the inner cell composite of the naturally grown plant structure, and producing of bending and splitting cracks on it, before the cutting into sections, by a impacting, snapping, and/or squeezing action, in such a way that nonfibrous components can fall out and/or any moisture can easily evaporate.

2. Device according to claim 1, characterized in that said at least one tool has a range of action smaller than the cutting blade.

3. Device according to claim 2, characterized in that the at least one impact or snapping tool (5), which carries out the impacting, snapping-off, and/or squeezing, is segmented into individual parts.

4. Device according to claim 3, characterized in that the at least impacting, snapping and/or squeezing tool (5) is suspended in a flexible/oscillating manner in the rotor (3).

5. Device according to claim 3, characterized in that it contains a counter support (6) against which or past which the impacting, squeezing, pounding, and/or snapping action as well as the subsequent cutting operation is executed.

6. Device according to claim 5, characterized in that below the counter support (6), a rough friction surface (8) is placed, above which the pre-disintegrated material, cut into sections, is slid by the at least one cutting blade (4), and another part of the loosened, nonfibrous material is detached by friction and jolting.

7. Device according to claim 6, characterized in that it is installed so that it is stationary.

8. Device according to claim 6, characterized in that it is constructed so that it can move.

9. Device according to claim 5, characterized in that it is combined with a moving machine.

10. Process for pre-disintegrating and cutting into sections stalk- and stem-like, fibrous plant material for the purpose of decortication, comprising the steps of:

(a) treating said plant material mechanically by at least one impact or snapping tool; and (b) cutting the plant material into sections by a cutting blade (4), in order to loosen/pre-disintegrate the grown plant structure by cross-breaks and longitudinal cracks, in such a way, that the moisture contained therein is evaporated and/or a large part of the wood- and shive-like secondary products are detached from the composite with the fibers, so as to be able to separate them.

11. Process according to claim 10, further comprising the step of sliding the pre-disintegrated plant material over a rough friction zone, after the cutting into sections of a stationary unit, with the goal of bringing about more extensive pre-disintegration and separation of already extensively detached wood-like/shive-like components from the predominately fibrous or not yet appreciably pre-disintegrated material.

* * * * *